United States Patent [19]

Tsukamura et al.

[11] 4,420,268

[45] Dec. 13, 1983

[54] PRINTING APPARATUS AND TAPE CLAMP THEREFOR

[75] Inventors: Yoshihiro Tsukamura, Kawasaki; Hidekuni Aizawa, Yokohama; Keiichi Ohta, Atsugi, all of Japan

[73] Assignee: Sony Corporation, Tokyo, Japan

[21] Appl. No.: 329,701

[22] Filed: Dec. 11, 1981

[30] Foreign Application Priority Data

Dec. 11, 1980 [JP] Japan ..... 55-178143[U]

[51] Int. Cl.[3] ..... B41J 33/14

[52] U.S. Cl. ..... 400/233; 400/120; 400/208

[58] Field of Search ..... 400/120, 233, 208

[56] References Cited

U.S. PATENT DOCUMENTS 3,855,448 12/1974 Hanagata et al. ..... 400/120 X 4,157,224 4/1979 Purzycki et al. ..... 400/233

OTHER PUBLICATIONS

IBM Technical Disclosure Bulletin, vol. 7, No. 3, Aug. 1964, pp. 250–251.

IBM Technical Disclosure Bulletin, vol. 23, No. 4, Sep. 1980, pp. 1517–1520.

*Primary Examiner*—Clifford D. Crowder

*Attorney, Agent, or Firm*—Lewis H. Eslinger; Alvin Sinderbrand

[57] ABSTRACT

A thermal printing apparatus includes a platen about which a sheet of paper is circumferentially embraced; a head transfer carriage mounted on guide rails of the apparatus for slidable movement in the lengthwise direction of the platen; a thermal head assembly mounted only on one guide rail so as to move with the head transfer carriage in the lengthwise direction of the platen while also being adapted to pivot about the guide rail toward and away from the platen, such that a tape from a tape cartridge is positioned between the thermal head assembly and the paper so that as the thermal head assembly moves along the platen, it selectively heats the tape in response to an information signal to transfer the pigment from the tape onto the paper and thereby record visual information on the paper; a tape clamp device including a lever pivotally mounted to the apparatus, an elastic plate fixedly mounted to the apparatus, and a spring which biases the lever toward the elastic plate to clamp the tape therebetween during movement of the thermal head assembly in the recording operation; and another tape clamp device including a lever pivotally mounted to the head transfer carriage, an elastic plate fixedly mounted to the carriage and a spring which biases the lever toward the elastic plate to clamp the tape therebetween during movement of the thermal head assembly in the carriage return operation.

7 Claims, 10 Drawing Figures

FIG. 6
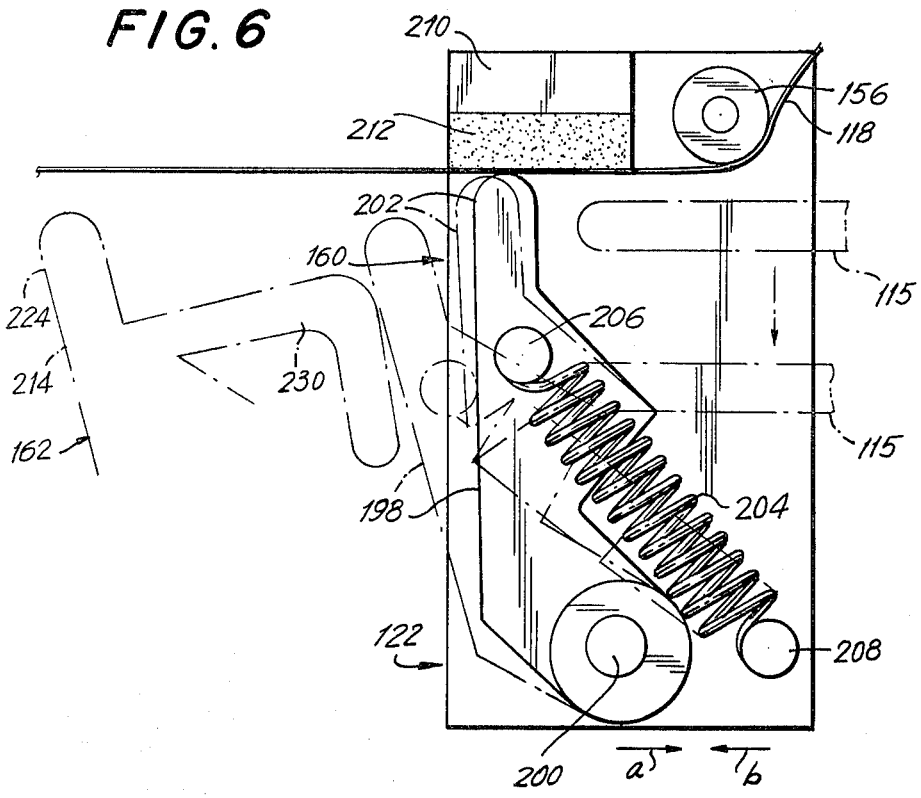
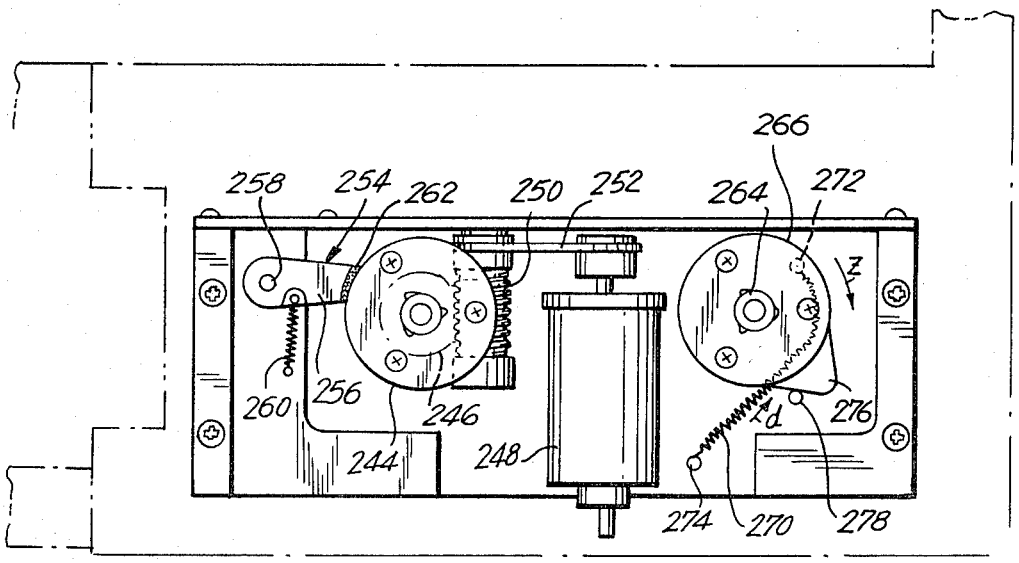
FIG. 7

PRINTING APPARATUS AND TAPE CLAMP THEREFOR

BACKGROUND OF THE INVENTION

1. Field of the Invention

This invention relates generally to printing apparatus and, more particularly, is directed to printing apparatus of the thermal transfer type.

2. Description of the Prior Art

Apparatus for printing visual information on recording paper in response to an information signal are well-known in the art. One such printing apparatus is of the thermal transfer type in which a pigment is selectively transferred from a tape to a record medium, such as a sheet of paper, by applying thermal energy to localized areas on the tape. As an example, a thermal head assembly of the apparatus may include a plurality of thermally excitable elements which, when activated, transfer the pigment to the paper as an arrangement of dots or other discrete elements.

Generally, the tape used with such printing apparatus is wound about two reels which are then positioned in the apparatus, with the segment of tape extending between the reels being positioned between the thermal head assembly and paper. With such arrangement, the thermal head assembly is moved in the longitudinal direction of the platen in contact with the segment of tape during the recording operation to transfer the pigment from the tape to the sheet of paper. After a horizontal line has been printed on the sheet of paper, the thermal head assembly is moved away from the platen out of contact with the tape and returned to its original position to begin printing another horizontal line on the sheet of paper.

During the return operation, a mechanism associated with the thermal head assembly is used for clamping the tape to withdraw an unused portion of tape from the supply reel along therewith for use in the printing operation of the next horizontal line. Such clamping mechanism may take the form of a pair of pinch rollers which pinch the tape therebetween. Such arrangement, however, may be unstable in that the tape held between the pinch rollers may slip during movement thereof in the return operation. In such case, a portion of the tape to be used for recording the next horizontal line may include both used and unused portions of tape.

Further, during the recording operation, that is, during the recording of each horizontal line on the paper, the segment of tape extending between the supply and take-up reels should be fixed so that the thermal head assembly slides therealong to always record on an unused portion of tape. However, during the recording operation, as a result of the heat generated by the thermal head assembly, the tape often sticks to the thermal head assembly. In such case, a used portion of tape will be transported with the thermal head assembly and repeatedly used during the printing of a horizontal line, with consequent deterioration of the printed line.

Another problem that may occur during the recording operation is that elongation of the tape extending between the thermal head assembly and the supply reel may be caused as a result of the heating of the tape by the thermal head assembly and friction existing between the tape and thermal head assembly. If such elongation is not corrected, sag or slack in the tape caused by such elongation may result in misalignment of the tape on a guide roller or pin positioned between the thermal head assembly and supply reel. In such case, the tape may be guided or ride on the rim or flanged portion of the guide roller or pin, resulting in a consequent misalignment of the tape and thermal head assembly. In such case, normal contact of the thermal head assembly on the tape during the recording operation may not be effected so as to result in a deterioration of the printed line of information.

OBJECTS AND SUMMARY OF THE INVENTION

Accordingly, it is an object of this invention to provide a printing apparatus that avoids the above-described difficulties encountered with the prior art.

More particularly, it is an object of this invention to provide a printing apparatus that includes a first clamp device associated with the thermal head assembly for stably and securely withdrawing an unused portion of tape from the supply reel during the return operation of the thermal head assembly.

It is another object of this invention to provide a printing apparatus that securely clamps the tape to prevent the latter from moving during the recording operation.

It is yet another object of this invention to provide a printing apparatus in which slack in the tape extending between the thermal head assembly and supply reel is taken up by the supply reel.

In accordance with an aspect of this invention, apparatus for producing visual information on recording paper in response to an information signal includes platen means associated with the recording paper; recording head means adapted to move relative to the paper for transferring a pigment from a tape positioned between the recording head means and the paper so as to record the visual information on the paper; first tape clamp means for withdrawing an unused portion of tape after the recording head means completes a recording operation with respct to the paper; and second tape clamp means for preventing movement of the tape during the recording operation.

The above, and other, objects, features, and advantages of the invention will be apparent in the following detailed description of illustrative embodiments of the invention which is to be read in connection with the accompanying drawings.

BRIEF DESCRIPTION OF THE DRAWINGS

FIG. 6 is an enlarged, top plan view of the first and second clamp devices of the apparatus of FIG. 3;

FIG. 7 is a top plan view of the supply and take-up reel assemblies of the apparatus of FIG. 3;

DETAILED DESCRIPTION OF THE PREFERRED EMBODIMENTS

Figure 1:
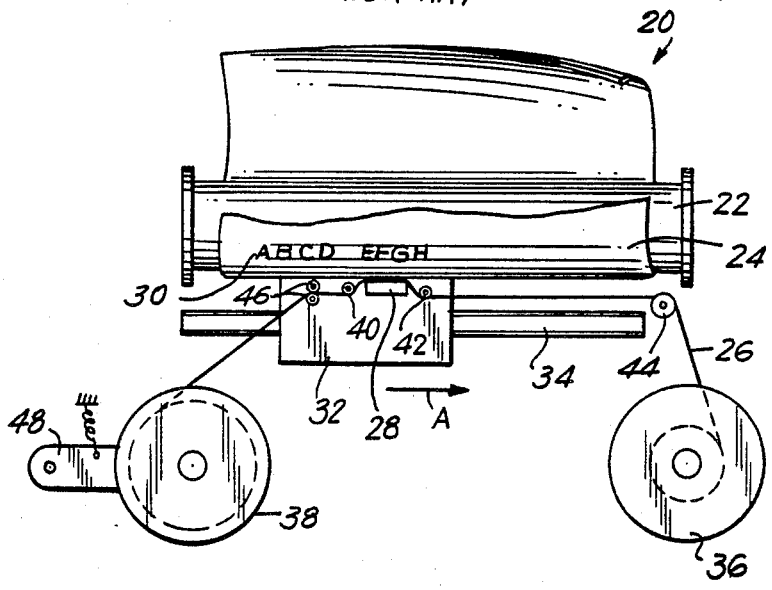
FIG. 1 PRIOR ART
FIG. 1 is a schematic, top plan view of a known printing apparatus.

Referring to the drawings in detail, and initially to FIG. 1 thereof, there is shown a printing apparatus 20 of the thermal transfer type according to the prior art. As shown therein, the apparatus includes a platen 22 having a recording sheet of paper 24 circumferentially embraced thereabout along a portion of its length, with recording sheet 24 preferably being supplied from a continuous paper supply roll. A tape 26, preferably of the thermal transfer type and a thermal head assembly 28 are also provided, with tape 26 being positioned between thermal head assembly 28 and recording sheet 24 for producing visual information 30 on recording sheet 24 in response to an information signal. It is to be noted that the visual information may consist of any combination of words, symbols, characters, patterns or the like.

The apparatus further includes a head transfer carriage 32 which is adapted to move in the lengthwise direction of platen 22 along a guide rail 34. Thermal head assembly 28 is mounted on head transfer carriage 32 in close proximity to platen 22 and is adapted to move with head transfer carriage 30 in the lengthwise direction of platen 22. As shown in FIG. 1, tape 26 is wound about a supply reel 36 and a take-up reel 38 and extends between such reels in the lengthwise direction of platen 22 between a pair of guide rollers 40 and 42 which are mounted on head transfer carriage 32 on opposite sides of thermal head assembly 28, and also around a guide roller 44 extending between supply reel 36 and guide roller 42. A tape press or hold device is also provided on head transfer carriage 32 and includes two pinch rollers 46 which are adapted to be pinched together with the tape therebetween during the return operation of head transfer carriage 30 in a direction opposite to arrow A in FIG. 1 for withdrawing an unused portion of tape from supply reel 36. However, during the recording operation, that is, when head transfer carriage 32 moves in the direction of arrow A in FIG. 1, pinch rollers 46 do not pinch tape 26 therebetween. With such arrangement of the tape press or clamp device according to the printing apparatus of FIG. 1, the tape pinched or clamped between pinch rollers 46 may slip during the return operation of head transfer carriage 32 in the direction opposite to arrow A in FIG. 1. In such case, when head transfer carriage 32 is returned to its left-most position in FIG. 1 to begin recording a new line, the tape extending between thermal head assembly 28 and guide roller 44 may contain previously used portions of tape.

The printing apparatus of FIG. 1 also includes a brake mechanism 48 for providing a braking force to take-up reel 38 to prevent movement of the tape during the recording operation so that thermal head assembly 28 always records on an unused portion of tape. However, as aforementioned, because of the heat applied to the tape by thermal head assembly 28, tape 26 may stick thereto during the recording operation, overcoming the braking force of braking mechanism 48. In such case, thermal head assembly 28 will record the line with a portion of used tape.

Figure 2:
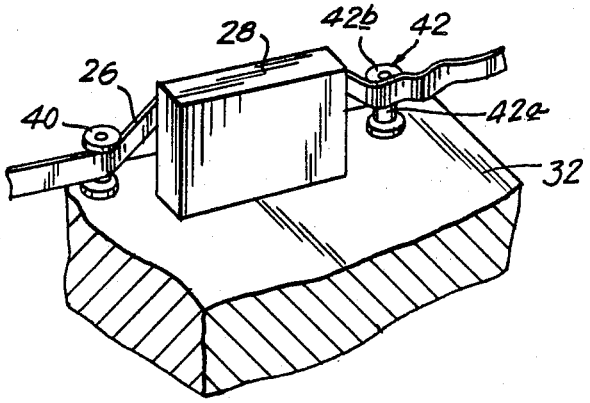
FIG. 2 PRIOR ART
FIG. 2 is a perspective, schematic view of a portion of the apparatus of FIG. 1.

Further, as previously described, during the recording of each line, the tape extending between thermal head assembly 28 and supply reel 36 may become elongated and thereby slacken as a result of heat applied to the tape by thermal head assembly 28 and friction produced between tape 26 and thermal head assembly 28. As shown in FIG. 2, guide roller or pin 42 may be comprised of a main roller portion **42*a* and an upper rim or flanged portion 42*b*. Thus, where the tape slackens between thermal head assembly 28 and supply reel 36, tape 26 may ride up from the main roller portion 42*a* onto flanged portion 42*b*. In such case, misalignment between thermal head assembly 28 and tape 26 may result, with a consequent deterioration of the printed visual information on paper 24**.

Figure 3:
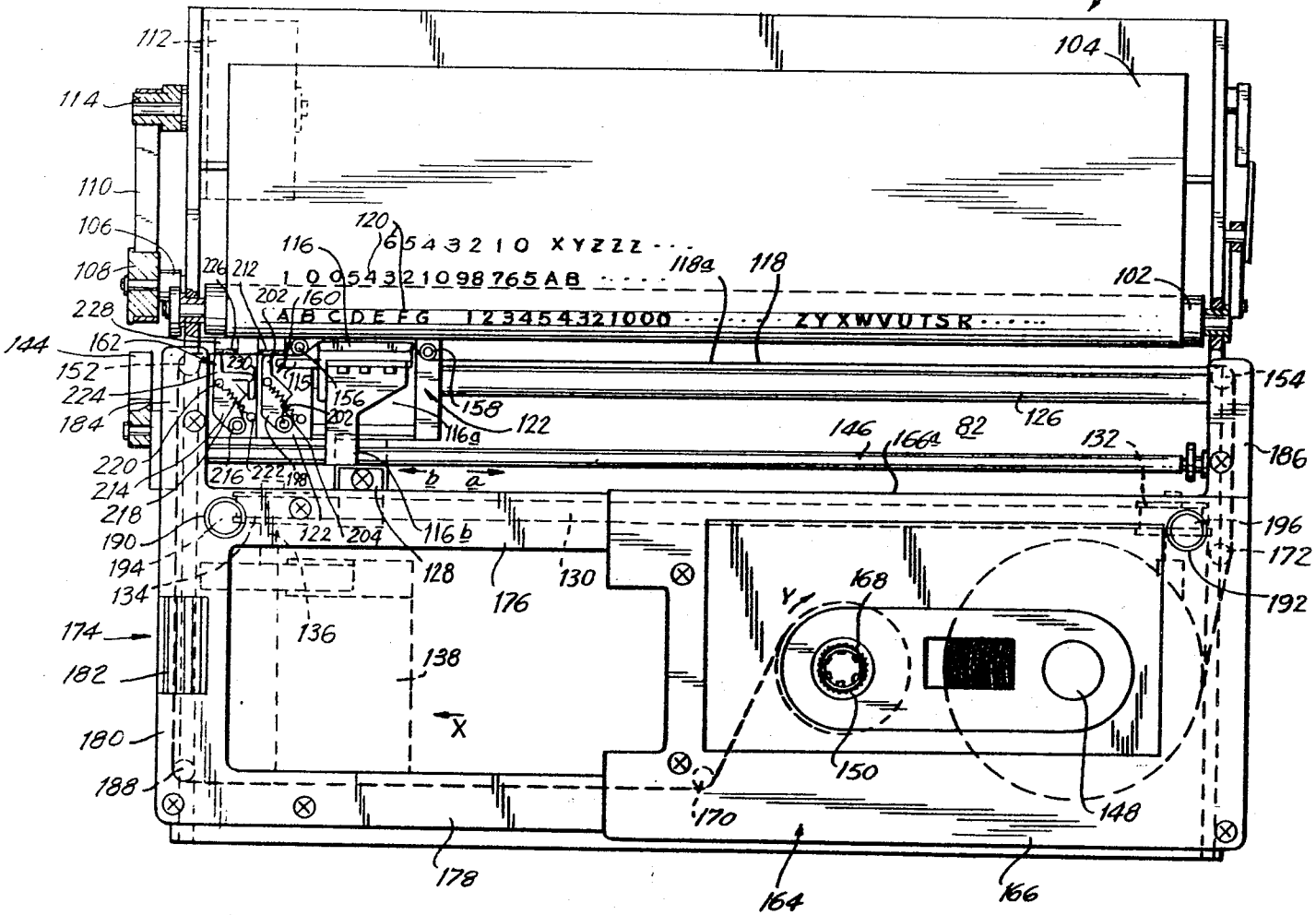
FIG. 3 is a top view of a printing apparatus according to one embodiment of this invention.
Figure 4:
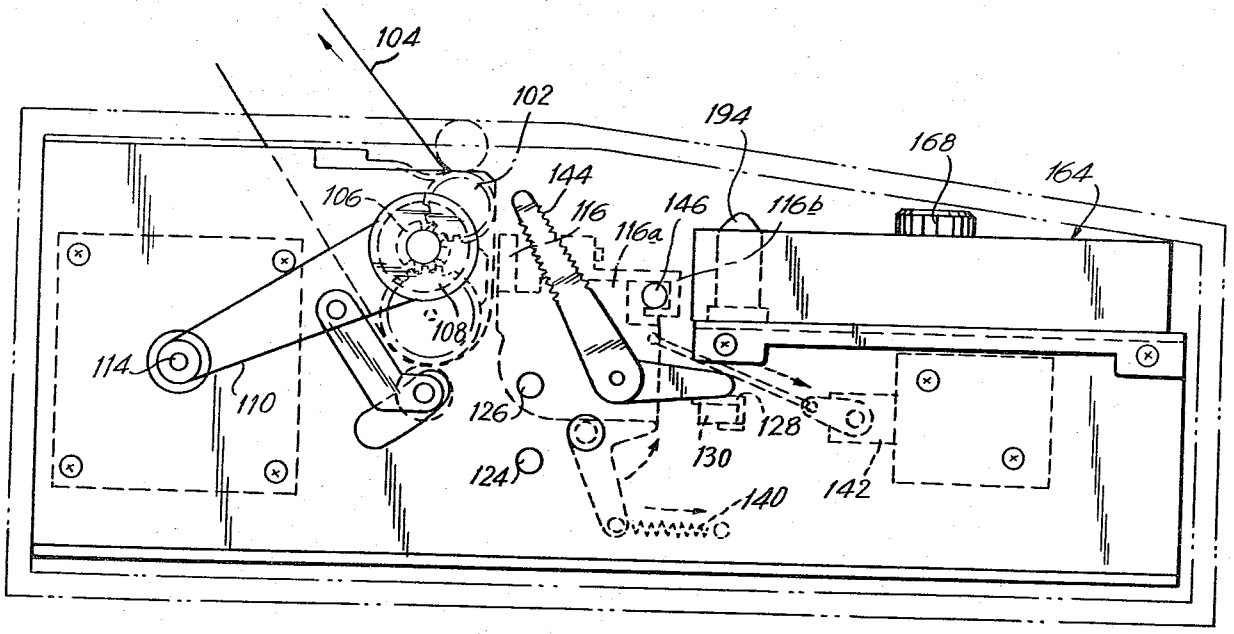
FIG. 4 is a side elevational view, partially in phantom, of a portion of the apparatus of FIG. 3.

Referring now to FIGS. 3 and 4, a printing apparatus 100 of the thermal transfer type according to this invention includes a platen 102 rotatably mounted in the apparatus and having a recording sheet of paper 104 circumferentially embraced thereabout along a portion of its length. Sheet 104 is preferably supplied from a continuous paper supply roll, and is advanced by means of a drive roller 106 which rotates the rollers of platen 102. Drive roller 106, in turn, is rotated through a pulley 108 secured thereto, a belt 110 which rotates the pulley and a drive motor 112 having an output shaft 114 about which belt 110 is also wrapped.

A thermal head assembly 116 is also provided and a segment of recording tape 118 from a cassette is positioned between thermal head assembly 116 and sheet 104 for printing visual information 120 on sheet 104 in response to an information signal. It is to be noted that the visual information may consist of any combination of words, symbols, characters, patterns, pictures or the like. If tape 118 is formed with a pigment layer covered by a protective layer, such as paraffin, the heating of the tape by thermal head assembly 116 results in the paraffin being melted, whereby the respective portion of the pigment layer is supplied to sheet 104. In this regard, thermal head assembly 116 may include a plurality of heating heads or transducers which occupy a width which is smaller than the width of the pigment layer on tape 104, as disclosed in U.S. Pat. Application Ser. No. 06/201,779, filed Oct. 29, 1980 and having a common assignee herewith, with each heating head preferably being made of a resistive material which is heated by an electrical signal supplied thereto. In the case where a plurality of different colored pigment layers are provided on the tape, a plurality of groups of the heating heads or transducers may be provided, as disclosed in the last-mentioned application. Thermal head assembly 116 also includes an arm 115 extending therefrom, as will be discussed in greater detail hereinafter.

Figure 5:
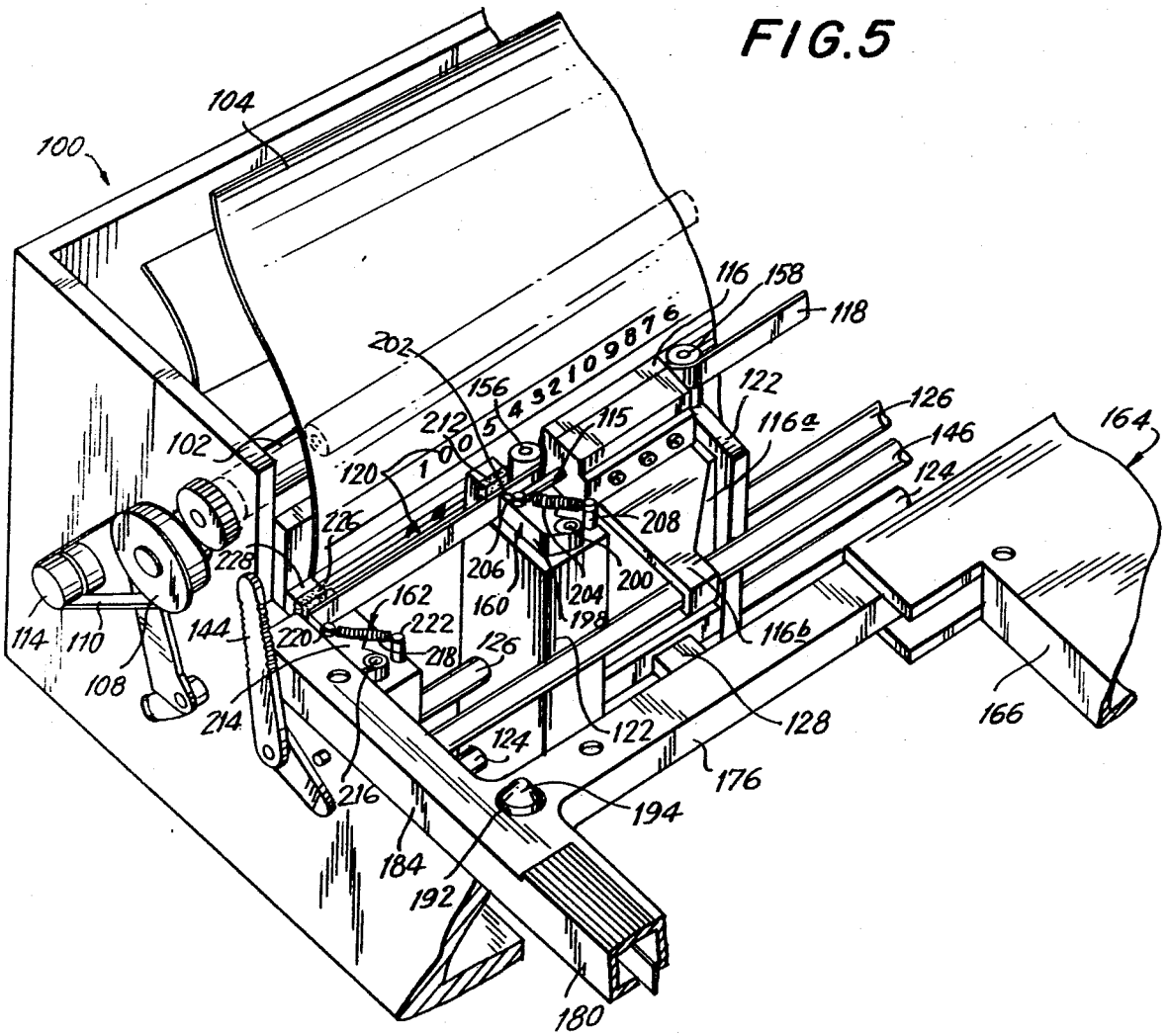
FIG. 5 is a perspective view of a portion of the apparatus of FIG. 3.

As shown in FIGS. 3–5, printing apparatus 100 includes a head transfer carriage 122 which is adapted to move in the lengthwise direction of platen 102, as shown by arrows a and b, along guide rails 124 and 126. In this regard, head transfer carriage 122 includes a connecting plate 128 which is attached to a driving belt 130 for moving head transfer carriage 122 in the directions of arrows a and b. Belt 130, in turn, is wrapped about a first pulley 132 and a second pulley 134, with the latter pulley being secured to an output shaft 136 of a motor 138 to be driven thereby. Thermal head assembly 116 is mounted on a support **116*a* which is rotatably mounted only on guide rail 126 in close proximity to platen 102 and is thereby adapted to move with head transfer carriage 122 in the lengthwise direction of platen 102. As will be apparent from the discussion hereinafter, thermal head assembly 116 may be biased toward and away from platen 102. In particular, as shown in FIG. 4, a spring 140 normally biases support 116***a*, and thereby thermal head assembly 116, toward platen 102. A solenoid assembly 142 is adapted to retract so as to pull support 116*a* and thereby thermal head assembly 116 away from platen 102 about guide rail 126 and against the force of spring 140. This latter movement is also effected by a rotatable lever 144 which is connected to a guide bar 146 which, in turn, is rotably connected only to a projection 116*b* of thermal head assembly 116 and not to head transfer carriage 122. Guide bar 146 is adapted to move in a direction perpendicular to arrow a in FIG. 1 in response to manual rotation of lever 144. Thus, when lever 144 is rotated, guide bar 146 is shifted in the aforementioned direction and thermal head assembly 116 is pivoted about guide rail 126 away from platen 102 and against the force of spring 140. Generally, however, lever 144 and guide bar 146 are used for pivoting thermal head assembly 116 away from platen 102 during the loading and unloading of a cassette into the apparatus, while solenoid assembly 142 performs this function during operation of the printing mechanism, as will be described hereinafter.

As shown in FIG. 3, tape 118 is wound about a supply reel 148 and a take-up reel 150 of the tape cassette, and a segment 118*a* of tape 118 extends between such reels in the lengthwise direction of platen 102 between tape guide rollers or pins 152 and 154 at opposite ends of the cassette, as will be discussed hereinafter in greater detail. The segment of tape extending between guide rollers 152 and 154 is further located between a pair of guide rollers or pins 156 and 158 mounted on head transfer carriage 122 at opposite sides of thermal head assembly 116. Further, as will be discussed in greater detail hereinafter, a first tape press or clamp device 160 for clamping the tape to head transfer carriage 122 during movement of the latter in the direction of arrow b, and a second tape press or clamp device 162 for clamping the tape to the apparatus during movement of head transfer carriage 122 in the direction of arrow a, are provided.

A tape cassette 164 that can be used with printing apparatus 100 according to this invention, and which is described and claimed in U.S. Pat. Application Ser. No. 06/329,700, filed Dec. 11, 1981 to Takao Miyashita et al., having a common assignee herewith, includes a cassette housing 166 comprised of an upper half and a lower half which, when assembled together, form an enclosed space. Supply reel 148 and take-up reel 150 are rotatably mounted on projections integral with the upper half and/or lower half of cassette housing 166 in a conventional manner. A take-up knob 168 may be secured to take-up reel 150 for winding tape 118 onto take-up reel 150. Further, tape guide rollers or pins 170 and 172 are provided adjacent take-up reel 150 and supply reel 148, respectively.

Tape cassette 164 also includes a tape drawing member 174 for adjusting the length of tape 118 extending between supply reel 148 and take-up reel 150. In particular, tape drawing member 174 includes hollow, parallel sliding members 176 and 178, which are connected together with one end thereof by a hollow connecting member 180 and which are slidably received within cassette housing 166 in a direction parallel to segment 118*a* of tape 118. Leaf springs may be provided at the free ends of sliding members 176 and 178 and contact either the upper half or lower half of housing 166 to provide a relative force between the sliding members and cassette housing 166 whereby to ensure smooth sliding movement of tape drawing member 174 with respect to cassette housing 166. A gripping portion 182 is also provided on connecting member 180, whereby the aforementioned sliding movement of tape drawing member 174 into and out of cassette housing 166 can be readily accomplished. Further, a tape guide roller or pin 188 is provided within tape drawing member 174 at the connecting corner between sliding member 178 and connecting member 180.

Further, a hollow projecting portion 184 extends orthogonally from the left-hand edge of tape drawing member 174 and includes tape guide roller or pin 152 at its free end, the latter free end being open along an inwardly facing portion thereof. A similar hollow projecting portion 186 extends from cassette housing 166 at the opposite right-hand edge thereof, as viewed in FIG. 3, and extends parallel to projecting portion 184. Tape guide pin 154 is provided at the free end of projecting portion 186 and the latter free end is open along an inwardly facing portion in opposing relation to the open portion at the free end of projecting portion 184. In this manner, tape 118 extends from supply reel 148, around guide roller 172, through projecting portion 186, around guide rollers 154 and 152, through projecting portion 184 and connecting member 180, around guide roller 188, through sliding member 178, around guide roller 170 and onto take-reel 150. With this arrangement, the segment 118*a* of tape 118 extending between guide rollers 152 and 154 is parallel to the nearest edge 166*a* of cassette housing 166 so as to define a space 82 therebetween. It is to be appreciated that, with such arrangement, the sliding movement of tape drawing member 174 in the direction of arrow X in FIG. 3, which also causes sliding movement of projecting portion 184 and tape guide roller 152, results in a lengthening of the segment 118*a* of tape 118 extending between guide rollers 152 and 154. In such case, however, the segment 118*a* of tape 118 remains parallel to the nearest edge 166*a* of cassette housing 166. If it is desired to shorten segment 118*a*, tape drawing member 174 is moved in the direction opposite to arrow X in FIG. 3 into cassette housing 166. In such case, take-up knob 168 is rotated to take-up the resultant slack in the tape so as to maintain segment 118*a* in a taut position between guide rollers 152 and 154.

For positioning tape cassette 164 in printing apparatus 100, as shown in FIG. 3, a guide or positioning aperture 190 is provided on sliding member 176 at the left-hand end of cassette 166 and a guide or positioning aperture 192 is provided in cassette housing 166 at the opposite end of cassette 164, whereby such apertures are adapted to be positioned over guide or positioning pins 194 and 196, respectively, of the apparatus. In this manner, cassette 164 can be accurately positioned within printing apparatus 100, with tape drawing member 174 being locked in its desired withdrawn position. At such time, supply reel 148 and take-up reel 150 are positioned over corresponding drive shafts of the apparatus.

Referring now to FIGS. 3, 5 and 6, printing apparatus 100 according to this invention further includes a first tape press or clamp device 160 secured to head transfer carriage 122. In particular, first tape clamp device 160 includes a tape clamp lever 198 pivotally mounted at one end thereof on head transfer carriage 122 by a pivot pin 200 and having a free clamp end 202. Lever 198 is normally biased in the clockwise direction, as viewed in the figures, by means of a spring 204 connected between a first mounting pin 206 secured to lever 198 and a second mounting pin 208 secured to head transfer carriage 122. In this manner, the free clamp end 202 of lever 198 is normally biased into pressing engagement with a restraining member 210 secured to head carriage assembly 122 and, in particular, with an elastic plate 212, for example, made of rubber, of restraining member 210, for gripping tape 118 between the free clamp end 202 of lever 198 and elastic plate 212. With such arrangement, when head transfer carriage 122 moves in the direction of arrow a in FIGS. 3 and 6, the friction force exerted between tape 118 and lever 198 overcomes the force of spring 204 whereby tape 118 moves in the direction of arrow b relative to the aforementioned movement of head transfer carriage 122. Accordingly, thermal head assembly 116 continuously prints with an unused portion of tape during the recording operation of each horizontal line on paper 104. On the other hand, at the end of the recording operation with respect to each horizontal line on the paper, head transfer carriage 122 is moved in the direction of arrow b in FIGS. 3 and 6. At such time, the fricton force exerted between tape 118 and lever 198 is added to the force of spring 204 so as to increase such force and securely clamp tape 118 between lever 198 and elastic plate 212. Accordingly, when head transfer carriage 122 is moved in the direction of arrow b, a new unused portion of tape 118 is withdrawn from supply reel 148 and pulled along with head transfer carriage 122 to the original position of the latter at the left-hand end of the apparatus. In this regard, during this latter return operation, because tape 118 is securely held between lever 198 and elastic plate 212, no slippage of the tape results.

Further, a second tape press or clamp device 162, in like manner, includes a tape clamp lever 214 pivotally mounted to apparatus 100 at the left-hand edge thereof by means of a pivot pin 216. Tape clamp lever 214 is normally biased in the clockwise direction, as viewed in the figures, about pivot pin 216 by means of a spring 218 connected between a first mounting pin 220 secured to lever 214 and a second mounting pin 222 secured to the apparatus. In this manner, the free clamp end 224 of lever 214 is normally biased into pressing engagement with an elastic plate 226, for example, made of rubber, of a restraining member 228 which is fixed to the apparatus. In addition, lever 214 includes an L-shaped arm 230 extending therefrom towards first clamp device 160. With such arrangement, when head transfer carriage 122 moves in the direction of arrow a in FIGS. 3 and 6, the friction force exerted between tape 118 and the free clamp end 224 of lever 214 adds to the force of spring 218. Accordingly, the tape is securely clamped between lever 214 and elastic plate 228 and is prevented from moving with head transfer carriage 122 in the direction of arrow a. On the other hand, when head transfer carriage 122 moves in the direction of arrow b in FIGS. 3 and 6, the tape is securely clamped to head transfer carriage 122 by first clamp device 160 so that a new unused portion of tape is withdrawn from supply reel 148. In such case, a slack occurs in the used portion of tape extending between first clamp device 160 and second clamp device 162. Accordingly, at such time, take-up reel 150 is rotated by a suitable motor 248 (FIG. 8) to take up such slack. At such time, the friction force exerted between lever 214 and tape 118 is sufficient to overcome the force of spring 218 so that tape 118 moves past second clamp device 162 where it is then wound on take-up reel 150. It is to be appreciated that, with such arrangement, if the tape sticks to thermal head assembly 116 during the recording of a horizontal line on the paper, such sticking does not result in the tape being moved in the direction of arrow b along with thermal head assembly 116 and head transfer carriage 122.

Figure 10:
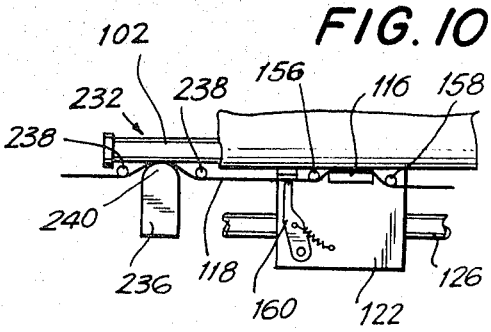
FIG. 10 is a top plan view of a second clamp device according to another embodiment of this invention.

Referring now to FIG. 10, a second tape press or clamp device 232 according to another embodiemt of this invention includes a press member 236 adapted to move into and out of pressing engagement with a roller of platen 102. In particular, press member 236 is positioned between two guide rollers 238 over which tape 118 passes. In this manner, press member 236 and, in particular, a curved end portion 240 thereof, is adapted to be moved into pressing engagement with platen 102 whereby to clamp tape 118 between end portion 240 of press member 236 and platen 102 during the recording operation by thermal head assembly 116.

Before describing the printing operation performed by printing apparatus 100, the positioning of tape cassette 164 in printing apparatus 100 will be described. In particular, lever 144 is rotated so as to move guide bar 146, and thereby thermal head assembly 116, away from platen 102. Accordingly, arm 115 secured to thermal head assembly 116 biases lever 198 of first tape clamp device 160 in the counter-clockwise direction, as viewed in FIG. 6, out of the aforementioned pressing engagement with elastic plate 212. The free clamp end 202 of lever 198, in turn, abuts against arm 230 of second clamp device 162 to thereby bias lever 214 of second clamp device 162 also in the counterclockwise direction, as viewed in FIG. 6, against the force of spring 218. In this manner, lever 214 is forced out of the aforementioned pressing engagement with elastic plate 226. Accordingly, when tape cassette 164 is positioned within printing apparatus 100, the segment **118*a* of tape 118 extending between guide guide rollers 152 and 154 is automatically positioned between thermal head assembly 116 and paper 104, between lever 198 of first clamp device 160 and elastic plate 212, and between lever 214 of second clamp device 162 and elastic plate 226. Thereafter, opposite movement of lever 144 and guide bar 146 result in the thermal head assembly 116 being moved in the direction toward platen 102, to the position shown in FIG. 3, into contact with tape 118** to initiate the printing operation.

During the operation of printing apparatus 20, thermal head assembly 116 and head transfer carriage 122 move in the direction of arrow a in FIG. 3 by means of drive belt 130 and motor 138. At such time, second tape clamp device 162 prevents the tape from moving so that thermal head assembly 116 prints one horizontal line of information on sheet 104. At the end of the printed line, solenoid assembly 142 pivots thermal head assembly 116 away from plate 102 but to a lesser extent than lever 144. Accordingly, arm 115 of thermal head assembly 116 does not bias lever 198 of first tape clamp device 160 away from platen 102. Thereafter, as thermal head assembly 116 and head transfer carriage 122 are moved to their original positions, as shown in FIG. 3, first tape clamp device 160 on head transfer carriage 122 pulls a new segment **118*a* of tape 118 from supply reel 148. The excess slack in the tape is taken up by take-up reel 150 which is rotated by motor 248. When the position shown in FIG. 3 is reached, solenoid assembly 142 releases thermal head assembly 116 so that the latter is once again brought into contact with tape 118 for printing the next line. At the same time, paper 104 is advanced one line by motor 112** through the aforementioned arrangement.

Figure 8:
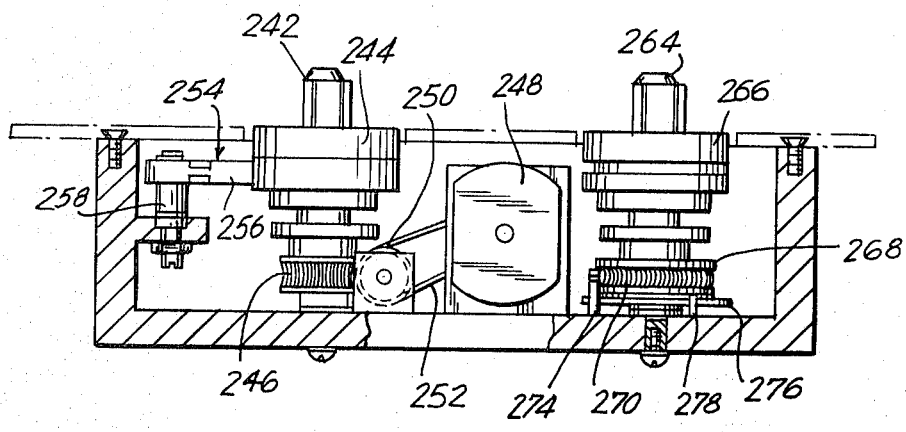
FIG. 8 is a side elevational view of the supply and take-up reel assemblies of the apparatus of FIG. 3.
Figure 9:
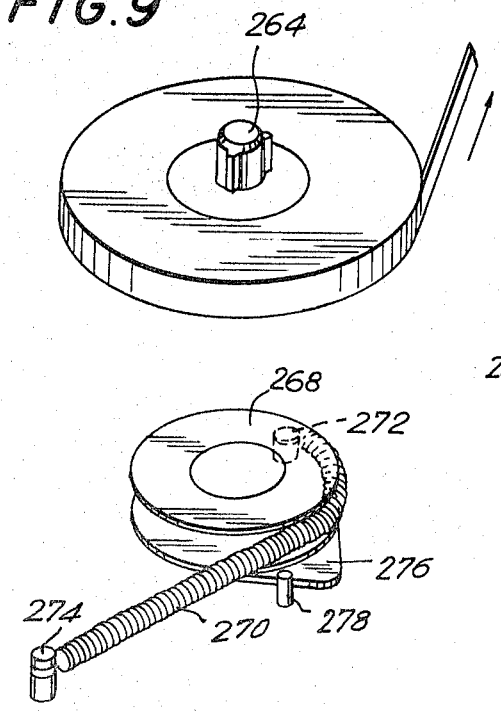
FIG. 9 is a perspective view of a portion of the supply reel assembly of the apparatus of FIG. 3.

Referring now to FIGS. 7–9, there is shown an arrangement for taking up slack in the tape. It is to be appreciated that, in one case, slack result from the return operation of thermal head assembly 116 and, in another case, can result from elongation of the tape caused by friction between the tape and the thermal head assembly and heating of the tape by such thermal head assembly. The slack caused by the return of thermal head assembly 116 will be discussed first. In particular, as shown in FIGS. 7 and 8, take-up reel 150 is positioned over a drive shaft 242 which, in turn, is coaxially connected to a reel holder 244 upon which take-up reel 150 sits when positioned over drive shaft 242. Drive shaft 242 is also coaxially connected with a worm wheel 246 which is connected to a take-up drive motor 248 through a worm gear 250 and a belt 252. When thermal head assembly 116 and head transfer carriage 122 are moved in the direction of arrow b in FIG. 3, the slack that results is taken up by take-up reel 150 which is rotated by motor 248 through belt 252, worm gear 250, worm wheel 246 and drive shaft 242.

In addition, a braking mechanism 254 in provided which includes a lever 256 pivotally mounted to the apparatus by a pivot pin 258 and which is normally biased in the clockwise direction, as viewed in FIG. 7, by a spring 260. In this manner, the tip 262 of lever 256 is biased into engagement with reel holder 244 to apply a braking force thereto whereby to aid second clamp device 162 so as to prevent tape on take-up reel 150 from being supplied during the recording operation by thermal head assembly 116. On the other hand, braking mechanism 254 does not prevent steel holder 244, and thereby take-up reel 150, from rotating in the direction of arrow Y in FIG. 3 to rewind take-up reel 150 and thereby take-up any slack in the tape during the return operation of thermal head assembly 116 and head transfer carraige 122.

In regard to the take-up of slack due to elongation of the tape, as aforementioned, supply reel 148 is positioned over a drive shaft 264 which is coaxially connected to a reel holder 266 on which supply reel 148 sits when positioned by drive shaft 264. A pulley 268 is also secured to the lower end of drive shaft 264 and a spring 270 is tensioned around pulley 268 between a pin 272 secured to pulley 268 and a pin 274 secured to the apparatus. In this manner, spring 270 normally biases pulley 268 so as to rotate supply reel 148 in the direction of arrow Z in FIG. 7 to maintain the tape extending between thermal head assembly 116 and supply reel 148 in a taut configuration and thereby absorb any tape elongation caused by friction and/or heat between tape 118 and thermal head assembly 116. The lower edge of pulley 268 includes a stop plate 276 which is adapted to abut against a pin 278 of the apparatus, as shown in FIG. 7, to prevent supply reel 148 from rotating past a predetermined extent at which the tension of spring 270 becomes ineffective. It is to be appreciated that, during each return operation of thermal head assembly 116 in the direction of arrow b in FIG. 3, supply reel 148 is rotated in the direction of arrow d in FIG. 7 whereby to rotate pulley 268 against the force of spring 270 so that the latter maintains the tape in a taut configuration during the next horizontal line recording operation.

Having described specific preferred embodiments of this invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for producing visual information on recording paper in response to an information signal, comprising:

platen means associated with said recording paper;

recording head means adapted to move in a first direction relative to said paper during a recording operation for transferring a pigment from a tape positioned between said recording head means and said paper so as to record said visual information on said paper and adapted to move in a second direction relative to said paper during a return operation;

carriage means adapted to move with said recording head means in said first and second directions;

first tape clamp means for clamping said tape to said carriage means during movement of said recording head means in said second direction to withdraw an unused portion of tape after said recording head means completes a recording operation with respect to said paper and including first lever means pivotally mounted to said carriage means, first restraining means secured to said carriage means, and first biasing means for biasing said first lever means toward said first restraining means to clamp said tape therebetween; and second tape clamp means for clamping said tape to the apparatus during movment of said recording head means in said first direction to prevent movement of said tape during said recording operation and including second lever means pivotally mounted to said apparatus, second restraining means secured to said apparatus, and second biasing means for biasing said second lever means in said first direction toward said second restraining means to clamp said tape therebetween with a force which increases with an increasing force tending to pull the tape in the first direction.

2. Apparatus according to claim 1; in which said second biasing means includes a spring connected between said second lever means and the apparatus.

3. Apparatus according to claim 1; in which said first biasing means includes a spring connected between said first lever means and said carriage means.

4. Apparatus according to claim 1; in which said recording head means includes support means adapted to pivotally move toward and away from said platen means.

5. Apparatus according to claim 4; further including biasing means for biasing said support means toward said platen means, and pivot means for pivoting said support means away from said platen means against the force of said biasing means.

6. Apparatus according to claim 1; in which said recording head means includes arm means for pivoting said first lever means away from said first restraining means when said support means is pivotally moved away from said platen means.

7. Apparatus for producing visual information on recording paper in response to an information signal, comprising:

platen means associated with said recording paper;

recording head means adapted to move relative to said paper for transferring a pigment from a tape positioned between said recording head means and said paper so as to record said visual information on said paper, said recording head means including support means adapted to pivotally move toward and away from said platen means;

carriage means adapted to move with said recording head means relative to said paper;

first tape clamp means for withdrawing an unused portion of tape after said recording head means completes a recording operation with respect to said paper and including first lever means pivotally mounted to said carriage means, first restraining means secured to said carriage means, and first biasing means for biasing said first lever means toward said first restraining means to clamp said tape therebetween;

said recording head means further includes arm means for pivoting said first lever means away from said first restraining means when said support means is pivotally moved away from said platen means; and second tape clamp means for preventing movement of said tape during said recording operation and including second lever means pivotally mounted to said apparatus, second restraining means secured to said apparatus, second biasing means for biasing said second lever means toward said second restraining means to clamp said tape therebetween and arm means, and said first lever means pivots said second lever means away from said second restraining means through said arm means of said second tape clamp means when said first lever means is pivoted away from said first restraining means.

* * * * *